US009708101B2

(12) United States Patent
Kinskey et al.

(10) Patent No.: US 9,708,101 B2
(45) Date of Patent: Jul. 18, 2017

(54) PORTABLE BUCKET STORAGE SEAT ORGANIZER

(71) Applicant: LF Centennial Ltd., Road Town, Tortola (VG)

(72) Inventors: Terrence P. Kinskey, Alpharetta, GA (US); Matthew G. Williams, Lighthouse Point, FL (US)

(73) Assignee: LF CENTENNIAL LTD., Tortola (VG)

( * ) Notice: Subject to any disclaimer, the term of this patent is extended or adjusted under 35 U.S.C. 154(b) by 1154 days.

(21) Appl. No.: 13/778,833

(22) Filed: Feb. 27, 2013

(65) Prior Publication Data

US 2013/0228580 A1 Sep. 5, 2013

Related U.S. Application Data

(60) Provisional application No. 61/605,465, filed on Mar. 1, 2012.

(51) Int. Cl.
*B65D 25/04* (2006.01)
*B25H 3/00* (2006.01)

(52) U.S. Cl.
CPC ..... *B65D 25/04* (2013.01); *B25H 3/00* (2013.01)

(58) Field of Classification Search
CPC .. B65D 24/04; B65D 2251/105; B65D 33/06; B65D 2/04; B65D 33/065
USPC ..... 220/500, 544, 510, 522, 521
See application file for complete search history.

(56) References Cited

U.S. PATENT DOCUMENTS 4,593,816 A * 6/1986 Langenbeck ..... B65D 25/06 206/425
4,746,008 A * 5/1988 Heverly ..... B65D 55/02 206/1.5
5,350,065 A * 9/1994 Darrey ..... B65D 25/32 206/373
5,853,093 A * 12/1998 Neiger ..... B65D 41/0471 215/237
5,975,346 A * 11/1999 Imperato ..... B44D 3/123 220/284
D439,022 S * 3/2001 Brandeis ..... D3/308
7,121,407 B2 * 10/2006 Hurt ..... A01K 97/06 206/373
2003/0111476 A1 * 6/2003 Serio, Jr. ..... A45C 13/008 220/835

* cited by examiner

*Primary Examiner* — Anthony Stashick
*Assistant Examiner* — Blaine Neway
(74) *Attorney, Agent, or Firm* — Duane Morris LLP; J. Rodman Steele, Jr.; Gregory M. Lefkowitz

(57) ABSTRACT

A portable organizer adapted for removable installation on a bucket including a main body and a lid. The main body can include a bottom wall, at least one sidewall, and a rim extending proximate a top end of the at least one sidewall and substantially parallel to the bottom wall. The bottom wall and at least one sidewall can define a main compartment with an open top. The lid can attach to the main body at a first end and can be configured to pivot between a closed position covering the open top and a position where the open top is uncovered. The lid can also include first and second connectors on a first half of the lid and third and fourth connectors on a second half of the lid.

18 Claims, 10 Drawing Sheets

PORTABLE BUCKET STORAGE SEAT ORGANIZER

CROSS-REFERENCE TO RELATED APPLICATIONS

This application claims priority to U.S. Provisional Application No. 61/605,465, filed Mar. 1, 2012, entitled "PORTABLE BUCKET STORAGE SEAT ORGANIZER" the entirety of which is incorporated herein by reference.

FIELD OF THE INVENTION

The present invention relates generally to the field of organizers, and more particularly to a portable organizer that can also function as a seat and engage with a bucket.

BACKGROUND

Various portable organizers are known to be useful for storage and transport of various items including tools hardware, small parts and fasteners. In conventional tool organizers such as a tool box, items may be scattered haphazardly in a single large compartment or divided between multiple stacked trays so that it may be difficult to quickly locate and access a specific item at a work site. While conventional organizers and others of the prior art are useful in some instances, there are still numerous deficiencies and the potential for more useful portable organizers and features.

SUMMARY OF THE INVENTION

A portable organizer can be adapted for removable installation on a bucket is described. The portable organizer can include a main body and a lid. The main body can include a bottom wall, at least one sidewall, and a rim extending proximate a top end of the at least one sidewall and substantially parallel to the bottom wall. The bottom wall and at least one sidewall can define a main compartment with an open top. The lid can be attached to the main body at a first end of the main body and configured to pivot between a closed position covering the open top and a position where the open top is uncovered. The main body can also include a handle extending longitudinally from a second end of the main body, with the second end opposite the first end. The main body can also include a support surface at the first end and extending perpendicular to the rim.

The lid can include first and second connectors on a first lateral half of the lid and third and fourth connectors on a second lateral half of the lid. The first and third connectors can also be on opposing longitudinal halves of the lid from the second and fourth connectors. The first and second connectors can also be configured to removably attach to an outside of the rim and the third and fourth connectors can configured to removably attach to the sidewall or an inside of the rim.

The rim of the main body can also include first and second engaging portions. The first connector on the lid can be configured to removably engage with the first engaging portion, and the second connector can be configured to removably engage with the second engaging portion. The first and second connectors can also include projecting engagement members. The main body can also include third and fourth engaging portions on the sidewall or an inside of the rim. The third connector on the lid can be configured to removably engage with the third engaging portion, and the fourth connector can be configured to removably engage with the fourth engaging portion. The third and fourth connectors can also include a ridge and each of the third and fourth engaging portions can include a recess or aperture.

The main body can also include a channel adjacent the inside of the rim; and the lid can include a generally planar cover member and a lip extending substantially perpendicular to the cover member and adapted for fitting within the channel when the lid is in the closed position. The third and fourth removable connectors can also extend from the lip of the lid toward the inside of the main compartment, and the third and fourth removable connectors can be configured to removably engage with third and fourth receiving portions on the channel.

The lid can also include at least two reinforcing projections along an inside of the lip and the at least one sidewall can also include notches in a top edge of the sidewall. At least a portion of each of the reinforcing projections can rest within the notches and within the channel on the main compartment when the lid is in the closed position.

The main body can also include at least one support wall within the main compartment extending from the bottom wall to a top of the main compartment. The lid can also include at least one reinforcing rib on the lid. The at least one reinforcing rib can be configured to align with at least a portion of the top edge of the at least one support wall when the lid is in the closed position.

The portable organizer can also include at least one removable divider wall and first and second facing walls selected from at least one sidewall, at least one support wall, and a plurality of support walls. The removable divider wall can include a first flared edge and a second flared edge opposite the first flared edge. The first facing wall can include a first track for slidably engaging with the first flared edge, and the second facing wall can include a second track for slidably engaging with the second flared edge. A top edge of the at least one removable divider wall can also include a flared support portion. The bottom wall of the portable organizer can also include at least one pair of alignment members for receiving at least a portion of a bottom edge of the at least one removable divider wall between the pair of alignment members.

A portable organizer seat can be adapted for removable installation on a bucket. The portable organizer seat can include a main body having a bottom wall, at least one sidewall, and a rim extending from a top of the at least one sidewall and substantially parallel to the bottom wall, with the bottom wall and at least one sidewall defining a main compartment with an open top; and a lid attached to the main body at a first end of the main body and configured to pivot between a closed position covering the open top and a position where the open top is uncovered. The lid can include a generally planar cover member such that the cover member and the rim form a generally planar surface when the lid is in a closed position. The lid can also include first and second connectors on a first lateral half of the lid and third and fourth connectors on a second lateral half of the lid.

The main body of the portable organizer can also be generally circular. The rim can also include a ring portion extending generally perpendicular to the bottom wall, such that an underside of the rim defines a generally circular hollow for receiving an edge of an open top end of a bucket and the portable organizer seat is configured to removably cover the open top.

The portable organizer seat can also include a support surface and a handle. The support surface can be at the first end of the main body and extend perpendicular to the rim. The handle can extend longitudinally from a second end of the main body, with the second end opposite the first end.

These and other features, objects and advantages of the present invention will become more apparent to one skilled in the art from the following description and claims when read in light of the accompanying drawings.

DETAILED DESCRIPTION

A portable organizer adapted for ease of use and removable installation on a bucket is described herein. The portable organizer provides efficient, secure storage and organization for project tools, hardware, small parts and fasteners and can be easily transported from site to site. Additionally, the portable organizer can be placed horizontally on a bucket to provide easy access to the stored parts, a cover for an open top of the bucket, and a stable surface for use as seating or a tabletop. The portable organizer is also adapted to be easily carried using a handle and stored in a vertical orientation because of a unique support surface.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Figure 1:
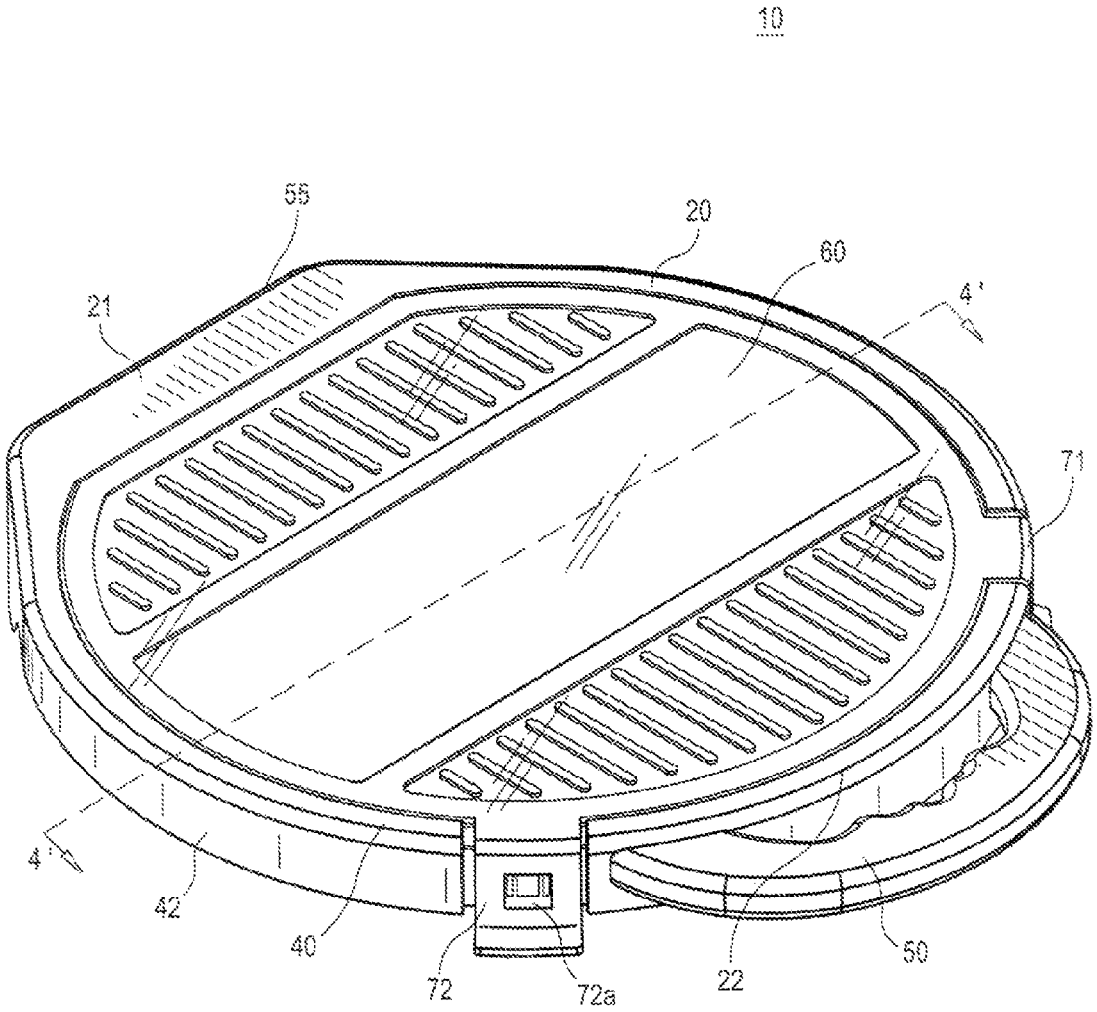
FIG. 1 is a perspective view of a portable organizer described herein.
Figure 10:
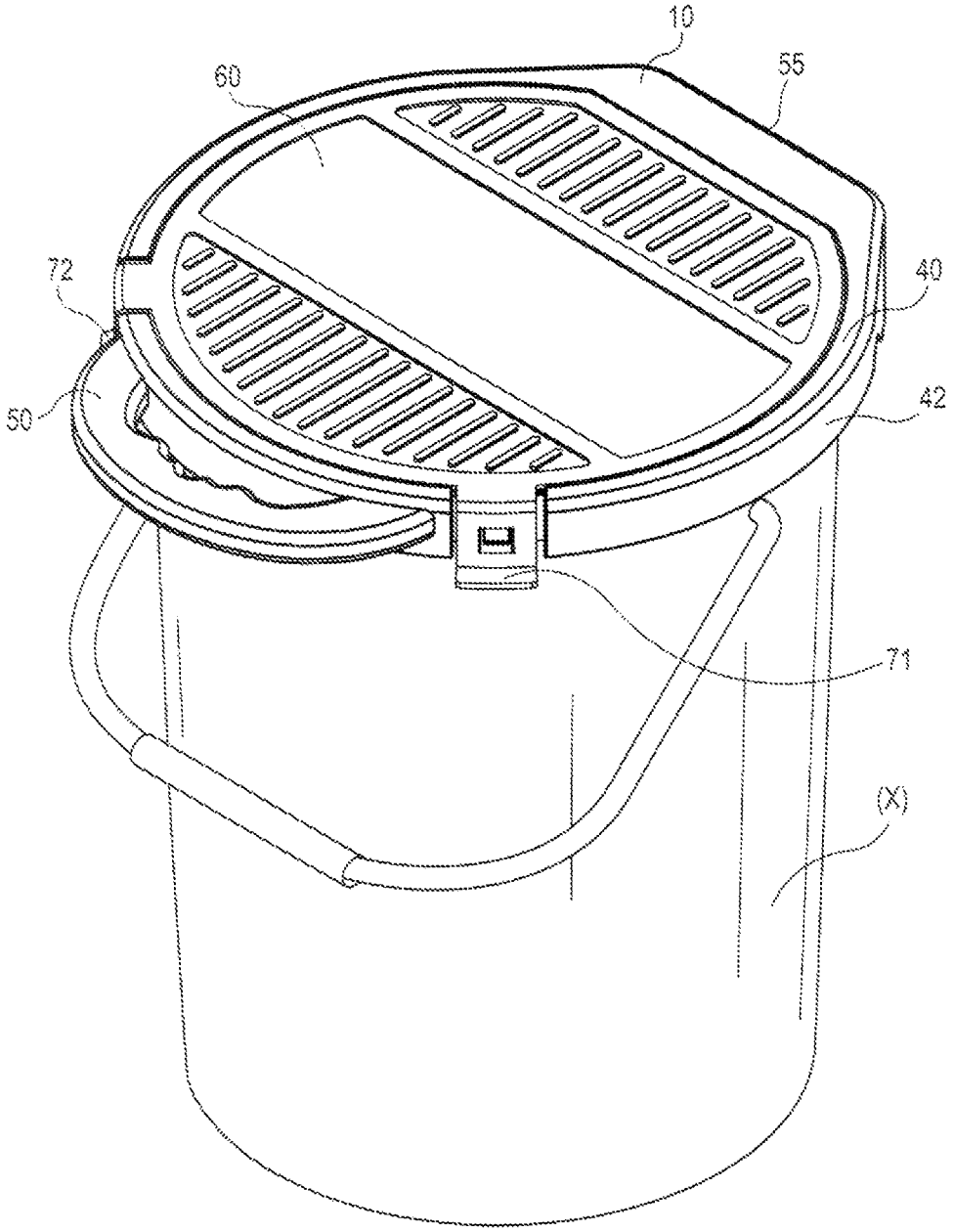
FIG. 10 is a perspective view of a portable organizer described herein installed on a bucket (X).

As used herein, the terms "top" and "bottom" refer to the vertical direction when the portable organizer is resting horizontally on its bottom wall as shown in FIG. 1. The term "longitudinal" refers to the vertical direction when the portable organizer is resting on the support surface, as shown in FIG. 10, while the term "lateral" refers to the horizontal direction in FIG. 10.

As shown in FIGS. 1-11, a portable organizer 10 is described herein. The portable organizer 10 can include a main body 20, with a first end 21 and a second end 22 opposite the first end 21, and a lid 60 attached to the main body 20 at the first end 21. The main body 20 can include a bottom wall 25 and at least one sidewall 30 defining a main compartment 35 with an open top.

Figure 8:
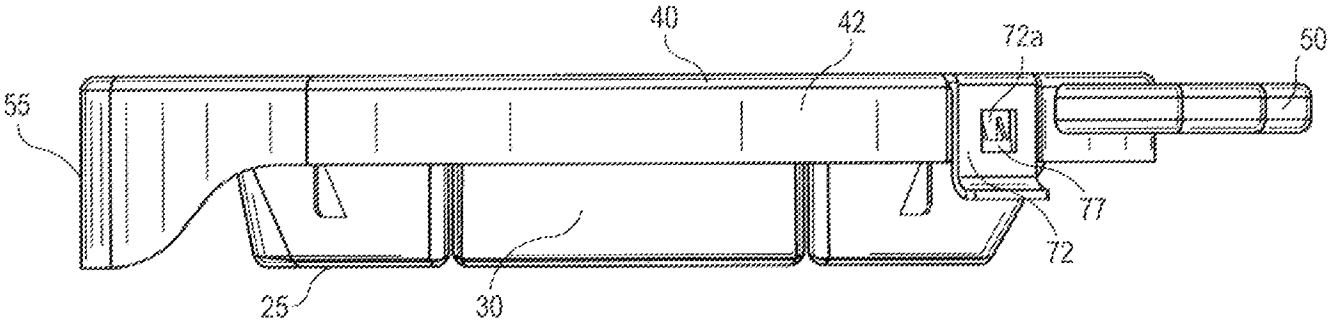
FIG. 8 is a right side view of a portable organizer described herein.
Figure 9:
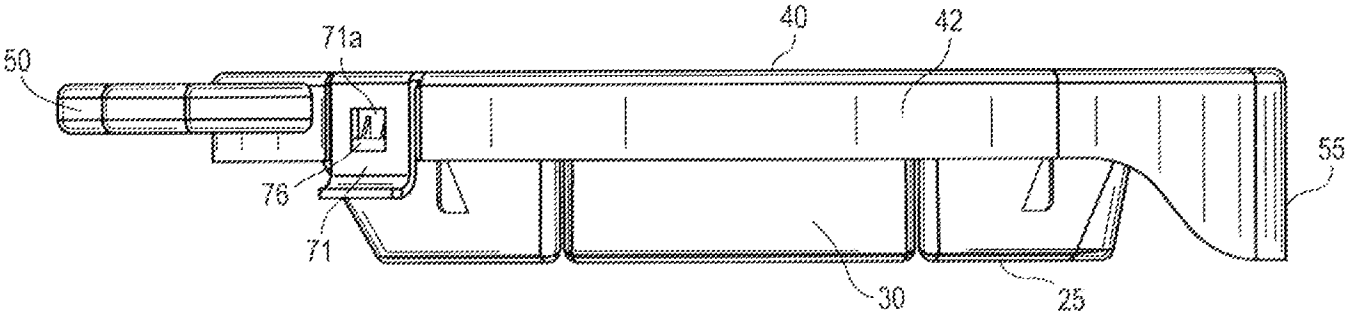
FIG. 9 is a left side view of a portable organizer described herein.

As best shown in FIGS. 8 and 9, the at least one sidewall 30 can have a generally cylindrical shape. The generally cylindrical shape of the at least one sidewall can be tapered such that a diameter of a top end of the at least one sidewall 30 is greater than the diameter of the bottom end of the at least one sidewall 30.

Figure 2:
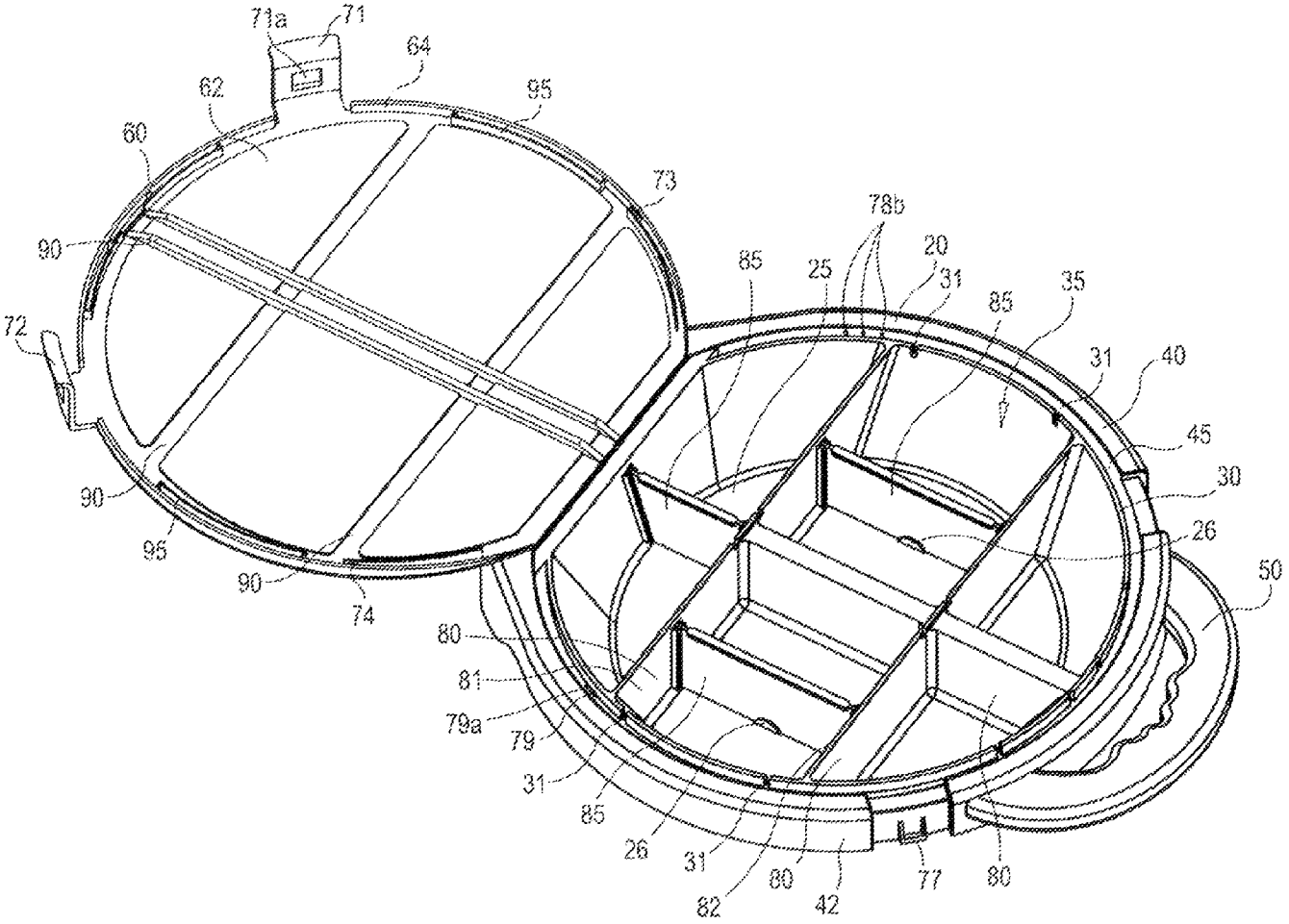
FIG. 2 is a perspective view of the portable organizer of FIG. 1 with the lid open.
Figure 3:
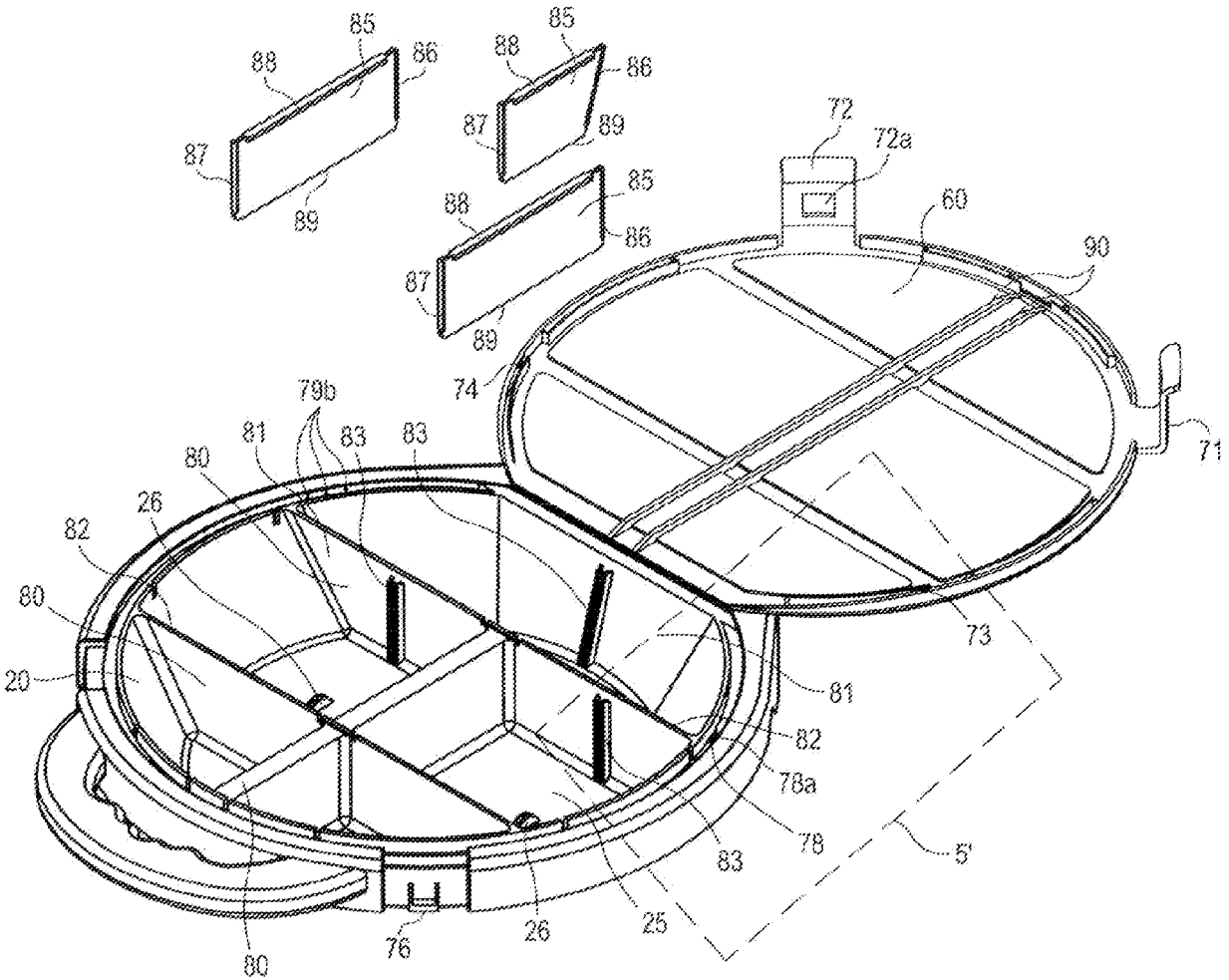
FIG. 3 is another view of the portable organizer of FIG. 1 with the lid open and the removable divider walls removed.

In one arrangement shown in FIGS. 2 and 3, the at least one sidewall 30 can be curved and form a generally circular main body 20. The at least one sidewall 30 can be continuous or interrupted by divider walls (e.g., 80). In other arrangements, the at least one sidewall 30 can include any combination of linear and curved sidewalls forming various main body 20 shapes. For example, the at least one sidewall 30 can include four linear sidewalls forming a square or rectangular main body 20.

Figure 4:
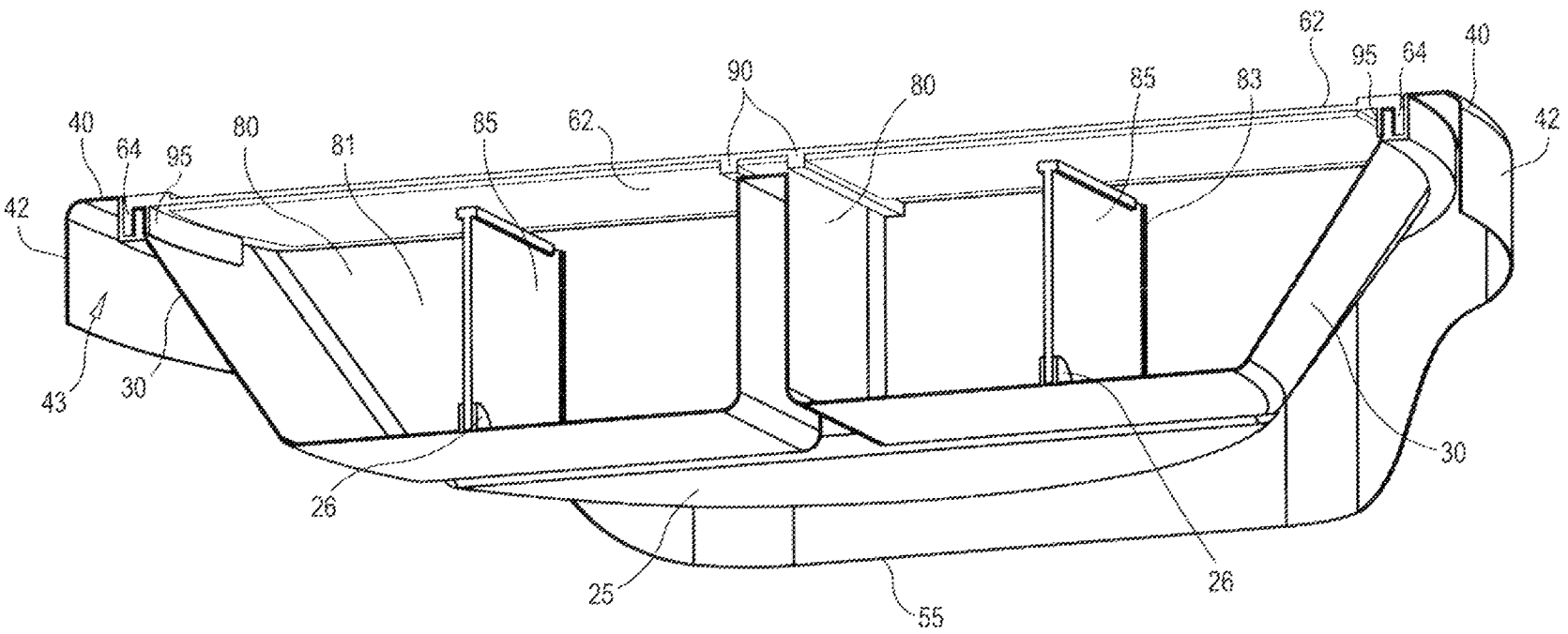
FIG. 4 is a cross-sectional view of the portable organizer of FIG. 1 taken along cut line 4-4.
Figure 7:
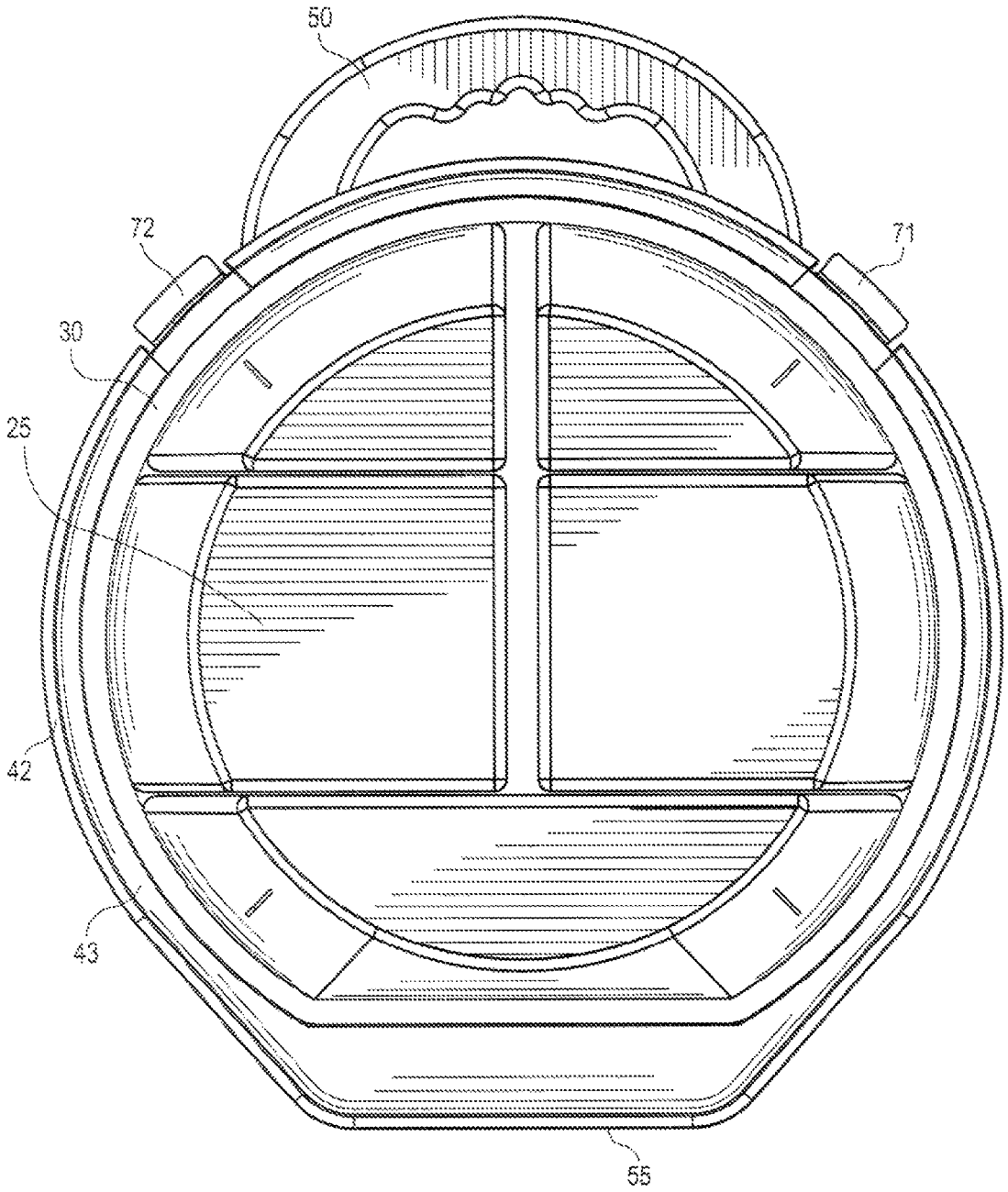
FIG. 7 is a bottom view of a portable organizer described herein.

As shown in FIGS. 1-3, the main body 20 can also include a rim 40 extending proximate a top end of the at least one sidewall 30 and substantially parallel to the bottom wall 25. As shown in FIG. 4, the rim 40 can also include a ring portion 42 extending generally perpendicular to the rim 40, such that the space between an outside surface of the at least one sidewall 30, an underside of the rim 40 and an inside surface of the ring portion 42 defines a hollow 43 for receiving an edge of an open top end of a container, such as a 5 gallon paint bucket (X). For example, the hollow 43 can be generally circular and adapted to receive the circular rim of a bucket, as shown in FIGS. 7 and 10.

The main body 20 can also include a channel 45 proximate the inner edge side of the rim 40. As used herein, the terms "inside," "inner," "outside" and "outer" refer to the portions most proximate and least proximate, respectively, to the main compartment 35. At least some portions of the channel 45 can be defined by the at least one sidewall 30, the rim 40, or both 30,40. For example as shown in FIGS. 2-5, an outer wall of the channel 45 can be formed by an inside edge of the rim 40 and an inner wall of the channel 45 can be formed by an outside surface of the sidewall 30.

Figure 11:
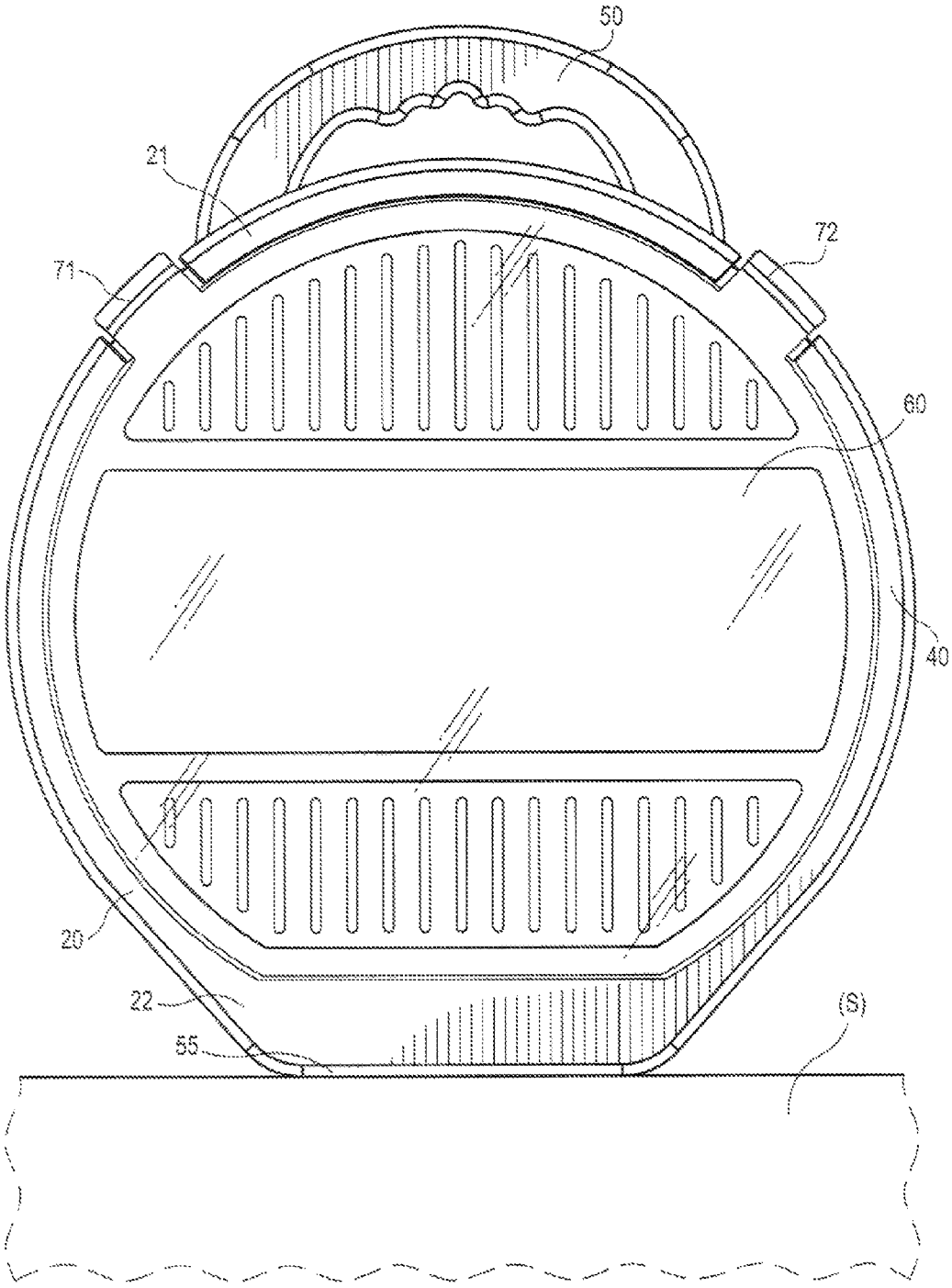
FIG. 11 is a perspective view of a portable organizer described herein resting vertically on a surface (S).

As shown in FIGS. 1-11, the main body 20 can also include a handle 50 extending longitudinally from the second end 22 of the main body 20. The handle 50 can extend from the rim, one or more sidewalls 30, the ring portion 42 or a combination thereof. The handle 50 can be configured to allow a user to grip or otherwise carry the portable organizer 10 in an upright (e.g., vertical) orientation. FIG. 11 shows the portable organizer resting on a surface (S) in an upright orientation.

The main body 20 can also include a support surface 55 at the first end 21 and extending perpendicular to the rim 40. As used herein, the term "support surface" refers to a surface feature configured to support the portable organizer 10 in an upright position when the support surface 55 is placed on a surface (S), such as the ground, a shelf or a work bench.

In one arrangement shown in FIG. 6-9, the support surface 55 can be a continuous substantially flat surface. In other arrangements, the support surface 55 can include a plurality of legs such as two, three, four or more legs extending laterally from the first end 21 of the portable organizer 10 (e.g., from the rim).

The lid 60 of the portable organizer 10 can be attached to the main body proximate the first end 21. The lid 60 can be configured to pivot between a closed position, as shown in FIG. 1, covering the open top of the main compartment 35 and a position where the open top is uncovered, such as shown in FIG. 2. The lid 60 can also include a generally planar cover member 62 and a lip 64 extending substantially perpendicular from the cover member 62. As shown in FIGS. 1, 8 and 9, the cover member 62 and the rim 40 of the main body 20 can also form a generally planar surface when the lid 60 is in the closed position. The lip 64 can be adapted for fitting proximate an inside of the rim 40 on the main body 20 when the lid 60 is in the closed position. The lip 64 can also be adapted for fitting within the channel 45 of the main body 20 when the lid 60 is in the closed position.

The lid 60 can include first and second connectors 71, 72 configured to removably connect to the main body 20 and secure the lid 60 in the closed position when connected. The lid 60 can also include third and fourth connectors 73, 74 configured to removably connect to the main body 20 and further secure the lid 60 in the closed position when connected.

The removable connectors 71, 72, 73, 74 can be spaced apart on the lid 60. For example as shown in FIGS. 2 and 3, the first and second connectors 71, 72 can be on a first lateral half of the lid 60 and the third and fourth connectors 73, 74 can be on a second lateral half of the lid 60, opposite the first lateral half. The first and third connectors 71, 73 can also be on a first longitudinal half of the lid 60 opposite a second longitudinal half to which the second and fourth connectors 72, 74 are attached. The connectors 71, 72, 73, 74 can include various types of engagement members including without limitation projecting engagement members, such as latches, hooks, clamps and clips; interference connectors; slip joint connectors; tongue in groove connectors; and other similar fasteners.

The connectors, including projecting engagement members extending from the lid 60, can be configured to attach to an outside or an inside of the rim 40 or an outside of the ring portion 42. In another arrangement, the connectors can be configured to removably attach to an interior portion of the main body 20, such as a sidewall 30, an inside of the rim 40, and/or the channel 45. The main body 20 can also include first, second, third and fourth engaging portions 76, 77, 78, 79 for engagement with the respective first, second, third and fourth connectors 71, 72, 73, 74.

Figure 5:
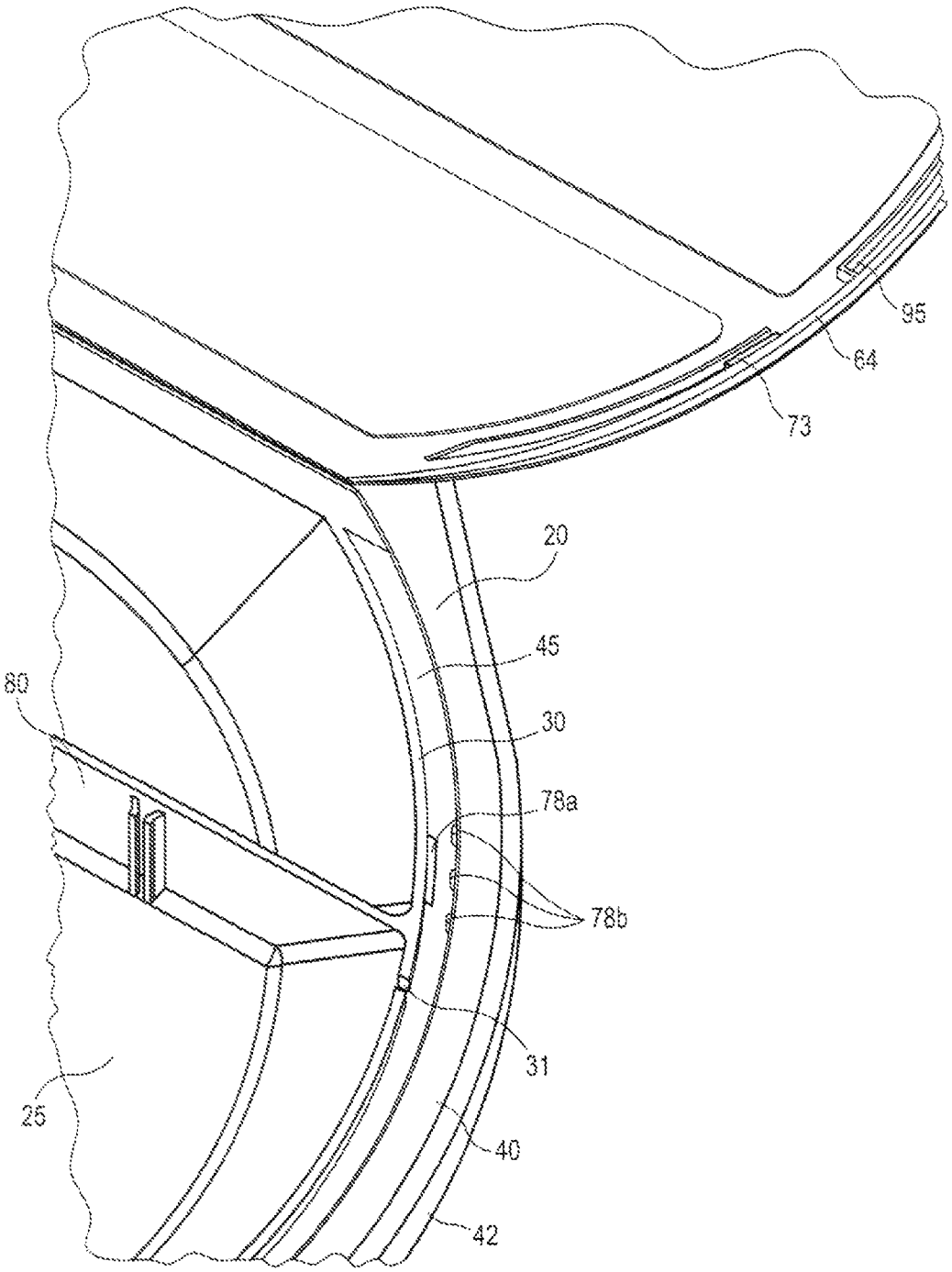
FIG. 5 is a magnified view of section 5' of the portable organizer of FIG. 3.
Figure 6:
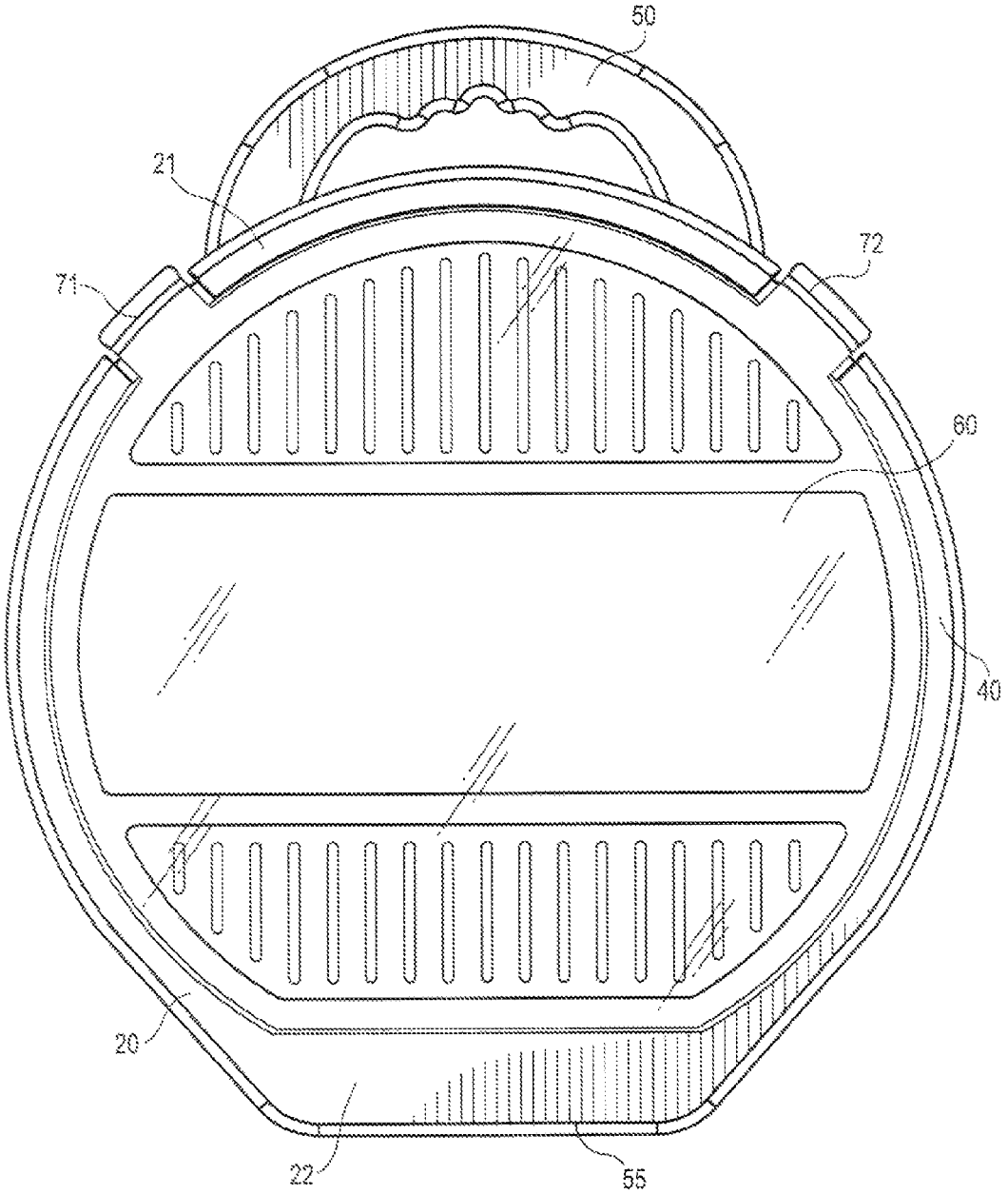
FIG. 6 is a top view of a portable organizer described herein.

In one arrangement shown in FIGS. 2, 3 and 5, the first and second connectors 71, 72 can be configured to removably attach to an outside of the rim 40 of the main body 20 or the ring portion 42 of the rim 40. The third and fourth connectors 73, 74 can be configured to removably attach to the sidewall 30, an inner side of the rim 40, and/or the channel 45. For example, the first and second connectors 71, 72 can include projecting engagement members, such as clips. The projecting engagement members 71,72 can extend from the cover member 62 of the lid 60 or the from the lip 64. The ring portion 42 can include engaging portions 76, 77 that are projections, and the first and second connectors 71, 72 can be clips that include openings 71*a*, 72*a* adapted for receiving the projections 76, 77, respectively. When the first and second connectors 71, 72 are clipped to the projections 76, 77, the lid 60 remains in a closed position even when the portable organizer 10 is carried or maintained in a vertical orientation.

The third and fourth connectors 73, 74 can include a ridge and the third and fourth engaging portions 78, 79 can include openings 78*a*, 79*b*. As used herein, the term "opening" refers to a feature adapted for receiving protruding portions of a connector and can include, without limitation, a recess or an aperture. The ridge of the third and fourth connectors 73, 74 can extend generally perpendicularly from the lip 64 of the lid 60, e.g., proximate a distal edge of the lip 64. The third and fourth engaging portions 78, 79 can include openings 78*a*, 79*a* adapted for receiving the third and fourth connectors 73, 74 respectively. The openings 78*a*, 79*a* can be located in walls of the channel 45 (e.g., inside or outside walls of the channel) and positioned such that the third and fourth connectors 78, 79 (i.e., the ridges) extend into the openings when the lid 60 is closed. The openings 78*a*, 79*a* can be positioned far enough down into the channel 45 that the third and fourth connectors 73, 74 are connected to the openings 78*a*, 79*a* when the user exerts force on the lid 60 on a surface of the lid 60 opposite the third and fourth connectors 73, 74. The distance between the inner edges of the third and fourth connectors 73, 74 can be smaller than the distance between the outer edges of the openings 78*a*, 79*a*.

As best shown in FIG. 5, one or both of the third and fourth engaging portions 78, 79 can also include at least one spacing member 78*b*, 79*b* positioned opposite the openings 78*a*, 79*a*. The spacing member(s) 78*b*, 79*b* can be positioned so that when the lid 60 is closed or nearly closing, the spacing member(s) 78*b*, 79*b* bias a portion of the lip 64 of the lid 60 proximate the spacing member(s) 78*b*, 79*b* away from the inside wall of the rim 40 (e.g., the outside wall of the channel 45) and toward the openings 78*a*, 79*a*, which can be disposed on the inside wall of the channel 45. By biasing the lip 64 toward the opening 78*a*, 79*a*, the spacing member(s) 78*b*, 79*b* help hold the third and fourth connectors 73, 74 more securely in the openings 78*a*, 79*a*.

The spacing member(s) 78*b*, 79*b* and the openings 78*a*, 79*a*, can be positioned on opposite sides of the channel 45 and can be proximate each other. For example, the spacing members 78*b*, 79*b* can extend from the outer wall of the channel 45 proximate the openings 78*a*, 79*a*. In some instances, at least one spacing member 78*b*, 79*b* can be radially aligned with at least one opening 78*a*, 79*a*. As used herein, "radially aligned" refers to an arrangement where a line extending from the center of the main compartment 35 passes through the aligned objects, e.g., a spacing member 78*b*, 79*b* and an opening 78*a*, 79*a*.

The base of the spacing members 78*b*, 79*b* can have a generally convex shape, including, but not limited to, a cylinder, a half cylinder, or a similar shape with a cross-section of a triangle, a square or another polygon. A top portion of the spacing member(s) 78*b*, 79*b* can also include a beveled portion for facilitating the biasing of the lip 64 of the lid 60 toward the inside wall of the channel 45 as the lid 60 is closed. For example, the beveled portion can extend from the outer wall of the channel 45 toward the innermost portion of the base of the spacing member 78*b*, 79*b*.

The portable organizer 10 can also include at least one support wall 80 within the main compartment 35 extending from the bottom wall 25 to a top of the main compartment 35. The support wall 80 can extend the length of the main compartment or only a portion of the length of the main compartment 35. The support wall can extend longitudinally or laterally. The portable organizer 10 can also include a plurality of support walls 80 dividing the main compartment 35 into sub-compartments as shown in FIG. 3. The at least one support wall 80 can also provide support to the lid 60 when the lid 60 is in the closed position. This is particularly useful when the lid 60 is being used as a seat for the user.

The portable organizer 10 can also include at least one removable divider wall 85 that can be removably inserted between two facing walls 81, 82 within the main compartment 35. The first and second facing walls 81, 82 can include any combination of sidewalls 30 or support walls 80. For example, the facing walls 81, 82 can include two support walls 80. The facing walls 81, 82 can also include a support wall 80 and a sidewall 30. The facing walls 81, 82 can also include two sidewalls 30 or the same sidewall 30 when the main body 20 is circular.

In one arrangement as shown in FIGS. 2 and 3, each removable divider wall 85 can also include a first flared edge 86 and a second flared edge 87 opposite the first flared edge 86. A top edge of the removable divider wall 85 can also include a flared support portion 88. The first facing wall 81 can also include a first track 83 for slidably engaging with the first flared edge 86 of the removable divider wall 85, and the second facing wall 82 can include a second track 84 for slidably engaging with the second flared edge 87 of the removable divider wall 85. The first and second tracks 83, 84 can be oriented to extend perpendicular to the bottom wall 25.

The bottom wall 25 of the main body 20 can also include at least one pair of alignment members 26. The pair of alignment members 26 can be adapted for receiving at least a portion of a bottom edge 89 of the removable divider wall 85 between the pair of alignment members 26, as shown in FIGS. 2-4.

The portable organizer 10 can also include at least one reinforcing rib 90 extending from the lid 60. As shown in FIGS. 2-4, the at least one reinforcing rib 90 can be configured to align with a top edge of the at least one support wall 80. The reinforcing rib(s) 90 and the support wall(s) 80 can extend longitudinally or laterally across the entirety of the main compartment 35. The support wall 80 can have a height such that the lid 60 contacts the top edge of the support wall 80 when the lid 60 is in the closed position.

The reinforcing rib 90 can extend completely across the lid 60 or only a portion of the of the lid 60. For example, the reinforcing rib 90 can extend longitudinally across the lid 60, as shown in FIG. 2. The reinforcing rib 90 can be provided in or project from the cover member 62 of the lid 60 in the form of projections, indentations, or combinations thereof.

In one arrangement, the main body 20 can include a support wall 80 extending longitudinally within the main compartment 35 and the lid 60 can include a corresponding reinforcing rib 90 extending longitudinally on an inner side of the cover member 62. In another arrangement, the main body 20 can include one or two support walls 80 extending laterally within main compartment 35 and the lid 60 can include one or two corresponding reinforcing ribs 90 extending laterally on an inner side of the cover member 62.

As shown in FIG. 2, the main body 20 can include at least three support walls 80 with one extending longitudinally and two extending laterally within the main compartment 35, and the lid 60 can include four corresponding reinforcing ribs 90 with two longitudinally extending and two laterally extending on an inner side of the cover member 62. As shown in FIG. 2, the longitudinally extending, reinforcing ribs 90 can be projections, while the laterally extending, reinforcing ribs 90 can be indentions.

The lid 60 of the portable organizer 10 can also include at least two reinforcing projections 95 extending from an inside of the lid 60. The reinforcing projections 95 can be positioned adjacent to the lip 64. The at least two reinforcing projections 95 can also be positioned on opposite sides of the lid 60. The reinforcing projections 95 can be received within portions of the main body 20, including portions of the rim 40, the channel 45 or the sidewall 30.

In one arrangement shown in FIGS. 2-5, the at least one sidewall 30 of the main body 20 can include notches 31 in a top edge of the sidewall 30. At least a portion of each of the reinforcing projections 95 can rest within the notches 31 when the lid 60 is in the closed position. At least a portion of each of the reinforcing projections 95 can extend across the channel 45 of the main body 20 when the lid 60 is in the closed position.

For example as shown in FIG. 2, a reinforcing projection 95 can include two end projections extending from an inside of the lid 60 generally perpendicular to the lip 64 connected by a middle projection extending from an inside of the lid 60 generally parallel to the lip 64. When the lid 60 is in the closed position, the end projections of the reinforcing projection 95 can extend across the channel 45 and/or the notches 31 in the sidewall 30. The middle projection can be located adjacent and inside of the sidewall 30, while the lip 64 can be located adjacent to the sidewall 30.

As shown in FIG. 10, the portable organizer 10 can be adapted to be supported horizontally on a container, such as a bucket (X). When supported on a bucket (X), the portable organizer 10 provides a number of advantages including an convenient location for the stored parts; a storage organizer that can be efficiently transported together with the bucket (e.g. by carrying the bucket by the handle while the portable organizer 10 is installed); a removable cover for the open top of the bucket (X); and a stable surface that can support the weight for a user to sit on or to place additional items on the portable organizer 10. In some embodiments, the portable organizer 10 does not clip or otherwise attach to the bucket (X) on which is it supported.

The improved configuration of the portable organizer 10 further provides efficient and secure storage and organization for items that can be easily transported from site to site. In particular, the secure attachment of the lid 60 to the main body 20 when the lid is in the closed position allows a user to carry the portable organizer 10 by the handle 50 or set the portable organizer 10 in an upright position without the weight of the stored items causing the lid 60 to deform or open. The secure fit of the lid 60 on the main body 20 including the support walls 80 also allows a user to carry the portable organizer 10 by the handle 50 or set the portable organizer 10 in an upright position while keeping the stored items organized in their sub-compartments. Furthermore, the support surface 55 allows the portable organizer 10 to be set down on a surface using the handle 50 and remain in a vertical position without external support.

The foregoing is provided for purposes of illustrating, explaining, an describing embodiments of this invention. Modifications and adaptations to these embodiments will be apparent to those skilled in the art and may be made without departing from the scope or spirit of this invention.

The invention claimed is:

1. A portable organizer adapted for removable installation on a bucket, comprising:

a main body having a bottom wall, at least one sidewall, and a rim extending proximate a top end of said at least one sidewall and substantially parallel to said bottom wall, wherein said bottom wall and the at least one sidewall define a main compartment with an open top; and a lid attached to said main body at a first end of said main body and configured to pivot between a closed position covering said open top and an open position where said open top is uncovered, said lid comprising first and second connectors on a first lateral half of said lid and third and fourth connectors on a second lateral half of said lid, wherein said main body further comprises a ring portion extending generally perpendicular to the rim toward the bottom wall, and wherein a space between an outside surface of the at least one sidewall, an underside of the rim, and an inside surface of the ring portion defines a hollow adapted to receive an upper edge of an open top container in both the open position and the closed position, wherein said ring portion comprises a flat support surface at said first end, wherein said portable organizer can stand upright on said flat support surface when said lid is in the closed position.

2. The portable organizer according to claim 1, said main body further comprising a handle extending longitudinally from a second end of said main body, wherein said second end is opposite said first end, wherein said handle is adapted for supporting the portable organizer is a vertical orientation where the second end is up and the first end is down.

3. The portable organizer according to claim 1, wherein said first and third connectors are on opposing longitudinal halves of said lid from said second and fourth connectors.

4. The portable organizer according to claim 1, wherein said first and second connectors are configured to removably attach to an outside of said rim and said third and fourth connectors are configured to removably attach to said sidewall or an inside of said rim.

5. The portable organizer according to claim 1, said rim further comprising first and second engaging portions, wherein said first connector on said lid is configured to removably engage with said first engaging portion, said second connector is configured to removably engage with said second engaging portion, and wherein said first and second connectors comprise projecting engagement members.

6. The portable organizer according to claim 1, wherein said main body further comprises a channel adjacent said inside of said rim; and said lid further comprises a generally planar cover member and a lip extending substantially perpendicular to said cover member and adapted for fitting within said channel.

7. The portable organizer according to claim 6, wherein said third and fourth removable connectors extend from the lip of said lid and are configured to removably engage with third and fourth receiving portions on said channel.

8. The portable organizer according to claim 6, said lid further comprising at least two reinforcing projections extending substantially perpendicular to said cover member, wherein said at least two reinforcing projections are positioned radially inside of said lip and said at least one sidewall comprises notches in a top edge of said sidewall, wherein at least a portion of each of said reinforcing projections rests within said notches and within said main compartment when said lid is in the closed position.

9. The portable organizer according to claim 1, said main body further comprising at least one support wall within said main compartment extending from said bottom wall to a top of said main compartment, wherein said at least one support wall is integrally formed with said bottom wall.

10. The portable organizer according to claim 9, said lid further comprising at least one reinforcing rib on said lid, wherein said at least one reinforcing rib is configured to align with at least a portion of the top edge of said at least one support wall when said lid is in the closed position.

11. The portable organizer according to claim 9, further comprising at least one removable divider wall comprising a first flared edge and a second flared edge opposite said first flared edge; and first and second facing walls selected from the group consisting of said at least one sidewall, said at least one support wall, and a plurality of support walls;

wherein said first facing wall comprises a first track for slidably engaging with said first flared edge and second facing wall comprises a second track for slidably engaging with said second flared edge.

12. The portable organizer according to claim 11, wherein a top edge of said at least one removable divider wall comprises a flared support portion.

13. The portable organizer according to claim 11, wherein said bottom wall comprises at least one pair of alignment members for receiving at least a portion of a bottom edge of said at least one removable divider wall between said pair of alignment members.

14. A portable organizer seat adapted for removable installation on a bucket, comprising:

a main body having a bottom wall, at least one sidewall, and a rim extending from a top of said at least one sidewall and substantially parallel to said bottom wall, wherein said bottom wall and at least one sidewall define a main compartment with an open top; and a lid attached to said main body at a first end of said main body and configured to pivot between a closed position covering said open top and a position where said open top is uncovered, said lid comprising a generally planar cover member such that said cover member and said rim form a generally planar surface when said lid is in a closed position;

said lid further comprising first and second connectors on a first lateral half of said lid and third and fourth connectors on a second lateral half of said lid, wherein said main body further comprises a ring portion extending generally perpendicular to the rim toward the bottom wall, and wherein a space between an outside surface of the at least one sidewall, an underside of the rim, and an inside surface of the ring portion defines a hollow adapted to receive an upper edge of an open top container in both the open position and the closed position, wherein said ring portion comprises a flat support surface at said first end, wherein said portable organizer can stand upright on said flat support surface when said lid is in the closed position, and wherein said portable organizer further comprises a handle extending longitudinally from a second end of said main body, wherein said second end is opposite said first end.

15. The portable organizer seat according to claim 14, wherein said hollow is adapted for receiving a generally circular upper edge of an open top container.

16. The portable organizer according to claim 1, wherein, when the hollow receives an open-top container, the portable organizer is supported by the underside of the rim on the upper edge of the open top container.

17. The portable organizer according to claim 7, wherein a distance between inner edges of the third and fourth connectors is smaller than a distance between outer edges of the third and fourth openings, respectively.

18. The portable organizer according to claim 17, further comprising third and fourth spacing members extending from interior side surfaces of the channel opposite an interior side surface in which the third and fourth openings are positioned, wherein, when the lip is pressed into the channel, the third spacing member biases the third connector toward the third opening and the fourth spacing member biases the fourth connector toward the fourth opening.

* * * * *